United States Patent [19]

Baumgartner et al.

[11] Patent Number: 4,604,040

[45] Date of Patent: Aug. 5, 1986

[54] DISPLACEMENT MACHINE HAVING A HOUSING AND PISTON WITH SPIRAL WALLS

[75] Inventors: Hans Baumgartner, Viersen; Manfred Brandstadter, Dusseldorf; Rainer Sudbeck, Wassenberg, all of Fed. Rep. of Germany

[73] Assignee: Pierburg GmbH & Co., KG, Neuss, Fed. Rep. of Germany

[21] Appl. No.: 707,075

[22] Filed: Mar. 1, 1985

[30] Foreign Application Priority Data

Mar. 3, 1984 [DE] Fed. Rep. of Germany ..... 3407939

[51] Int. Cl.[4] ..... F01C 1/04; F01C 19/00

[52] U.S. Cl. ..... 418/55

[58] Field of Search ..... 418/55, 59, 60

[56] References Cited

U.S. PATENT DOCUMENTS 3,560,119 2/1971 Busch et al. ..... 418/55

FOREIGN PATENT DOCUMENTS 57-203801 12/1982 Japan ..... 418/55

*Primary Examiner*—John J. Vrablik

*Attorney, Agent, or Firm*—Roberts, Spiecens & Cohen

[57] ABSTRACT

A displacement machine for a fluid comprising a housing including a spiral wall containing a displacement body including a spiral wall engaged with the spiral wall of the housing to form chambers therewith. The spiral wall of the displacement body extends over an angle greater than 360° to provide overlapping first and second ends and the spiral wall extends axially on both sides of a transverse disc. The center of the displacement body is rotated around a closed circular path, and a crank arm is pivotably connected to the housing at a first pivot axis and to the displacement body at a second pivot axis in the region of the spiral wall of the displacement body. The transverse disc has a radial terminal edge extending between the overlapping first and second ends of the spiral wall of the displacement body. The disc travels in a slot in the spiral wall of the housing and the terminal edge is shaped in correspondence with the path of movement of the disc relative to the housing so that the distance between the terminal edge and the edge of the slot remains substantially constant at least during one-half of the travel of the displacement body along the closed circular path.

3 Claims, 6 Drawing Figures

DISPLACEMENT MACHINE HAVING A HOUSING AND PISTON WITH SPIRAL WALLS

FIELD OF THE INVENTION

The invention is related to a fluid displacement machine and, particularly, to a fluid pump.

In particular, the invention relates to a displacement machine which comprises a housing having a spiral wall which is engaged with a spiral wall of a displacement body forming chambers with the spiral wall of the housing. The spiral wall of the displacement body extends over an angle greater than 360° to provide overlapping first and second ends and the spiral wall of the displacement body extends axially on both sides of a transverse disc.

The displacement body is driven by a crank mechanism along a closed circular path and a crank arm is pivotably connected to the housing and to the displacement body to control movement of the displacement body along an open reciprocal path so as to produce a pumping action on the fluid in the chambers. The disc supporting the spiral wall of the displacement body terminates within the outer contour of the spiral wall and the crank arm is pivotably connected to the displacement body in the region of the spiral wall.

DESCRIPTION OF PRIOR ART

Such displacement machines have a unidirectionally proceeding pumping action with low relative speed of the displacement body in the housing and are therefore suitable for use as compressors or vacuum pumps in automotive vehicles with little, if any, lubrication.

This use, however, requires very small dimensions, particularly if the machine is to be placed in vehicles of streamlined shape whose engine space is very small.

In our earlier U.S. patent application No. 526,154 filed Aug. 24, 1983, now U.S. Pat. No. 4,526,521 there is described a displacement machine in which, in order to reduce its structural size, the spiral wall of the displacement body or piston is arranged on a disc which terminates within the outer contour of the spiral wall, said displacement body being driven by a crank mechanism and guided by a swing or crank arm which is pivotably connected to the displacement body in the region of the overlapped ends of the spiral wall.

By this construction, it is intended to achieve a reduction in the outside diameter of a conventional displacement machine by an amount equal to four times the crank length of the crank mechanism.

However, this construction causes a gap, which varies as a function of the movement, between an edge of the housing edge and the disc in the region between the overlapped ends of spiral wall of the displacement body by which the compression chamber is short-circuited with the suction chamber.

It is intended to block this gap by providing an extension on the swing arm which projects into the space between the overlapped ends of the spiral wall and which receives the disc within a slot in said extension.

The extension extends through an opening in the housing between the suction chamber and the pressure chamber so that assembly gaps of a considerable length, in turn, produce considerable losses in pressure.

SUMMARY OF THE INVENTION

An object of the invention is to provide improvements in a displacement machine of the aforementioned type, to reduce the gaps between the pressure and suction chambers which produce pressure losses.

This object is solved by the displacement machine in accordance with the invention by forming the terminal edge of the disc with a shape corresponding to the path of movement of said terminal edge of said disc relative to the opposed, bounding edge of a slot in the spiral wall of the housing upon movement of the displacement body so that the distance between said terminal edge of the disc and said bounding edge remains substantially constant, at least, during one half of the travel of the displacement body along the closed circular path produced by the crank mechanism.

In a specific embodiment, the terminal edge of the disc is of S-shape in order to maintain the constant distance between the terminal edge and the facing bounding edge of the slot.

In order to further minimize the short circuit gap between the pressure and suction chambers, the size of the slot in the housing wall which receives the disc is minimized by making the thickness of the disc as small as possible and less than the thickness of the spiral wall of the displacement body.

The desired use of the displacement machine for automotive vehicles has been made possible by the invention. The displacement machine of the invention is characterized by small structural size, low weight and high capacity. The reduced pressure losses result in a reduction in power loss.

DETAILED DESCRIPTION OF THE PREFERRED EMBODIMENTS

Figure 1:
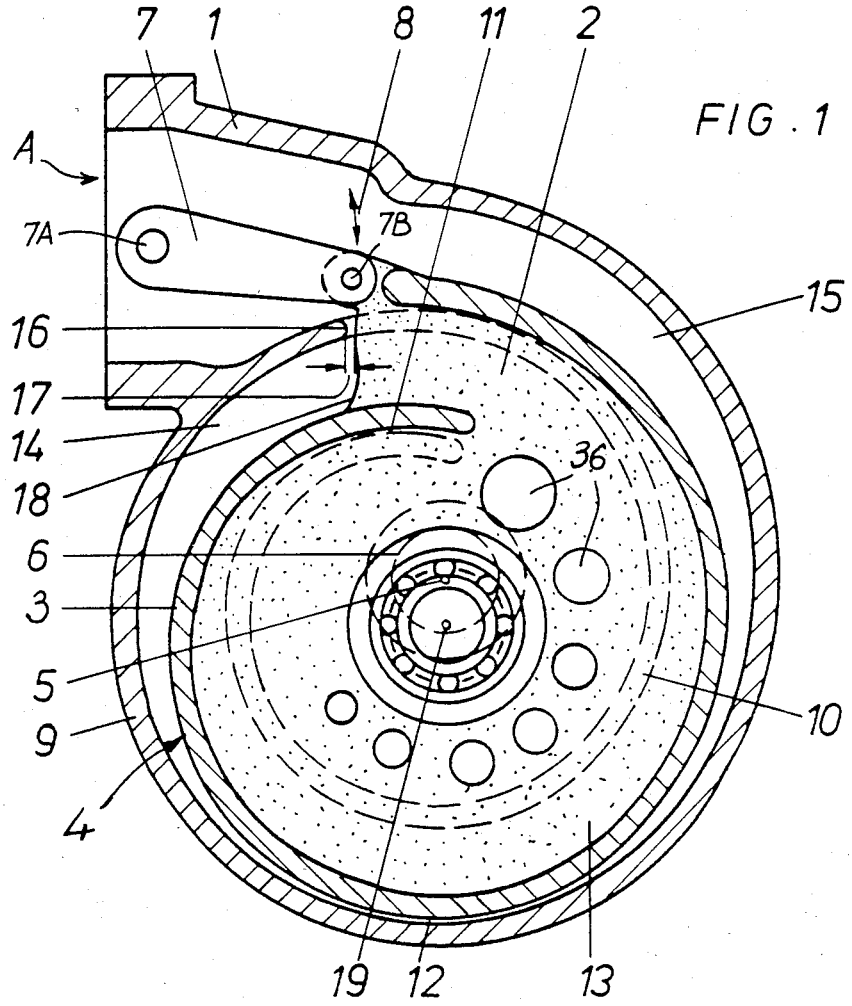
FIG. 1 is a transverse sectional view through a fluid displacement machine according to the invention.

In the drawing is shown a fluid displacement machine which will be described hereafter in its mode of use as a fluid pump.

The pump comprises a housing 1 composed of left and right halves 1A, 1B. The housing 1 accommodates a displacement body 4 constituting a piston which in the embodiment shown, by way of example, receives a fluid at an inlet A and delivers the fluid at an outlet B. The flow path of the fluid is shown by the arrows in FIG. 3 and could be reversed if desired. The inlet A is connected to an upper housing portion (not shown) which communicates with a fluid source.

Figure 2:
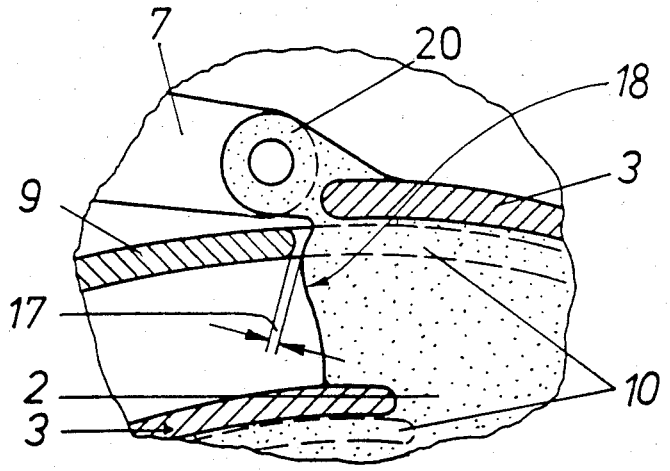
FIG. 2 is an enlarged view of a portion of the machine in FIG. 1.

The piston 4 comprises a transverse web or disc 2 from which a spiral rib or wall 3 extends axially from both sides of the disc. As seen in FIGS. 1 and 2, the ends of the spiral wall 3 overlap one another and in these Figures, the disc is shown with stippling in order to highlight its presence as its configuration represents one of the features of the invention.

The piston 4 is driven by a crank mechanism 5 on a closed circular path 6 (FIG. 1) and the movement of the piston 4 is controlled by connection of the piston to a crank arm 7 which is pivoted at end 7A to housing 1 and at end 7B to the disc 2 of the piston 4. As a consequence of the connection of the disc to the crank arm 7, the connection at 7B is constrained to pivot about connection 7A to undergo oscillatory movement along an open arcuate path shown by arrows 8. As a consequence, the piston 4 undergoes a complex path of travel in which its spiral wall 3 carries out a displacement movement whose envelope curve is encircled by a spiral wall 9 of the housing which overlaps itself to form inner wall 10. The spiral wall 3 of the piston 4 slides on the walls 9 and 10 with linear contact at locations 11, 12 to form therebetween crescent-shaped cavities or chambers 13,14,15 within which fluid can be conveyed unidirectionally as a result of the displacement movement of the piston.

Figure 3:
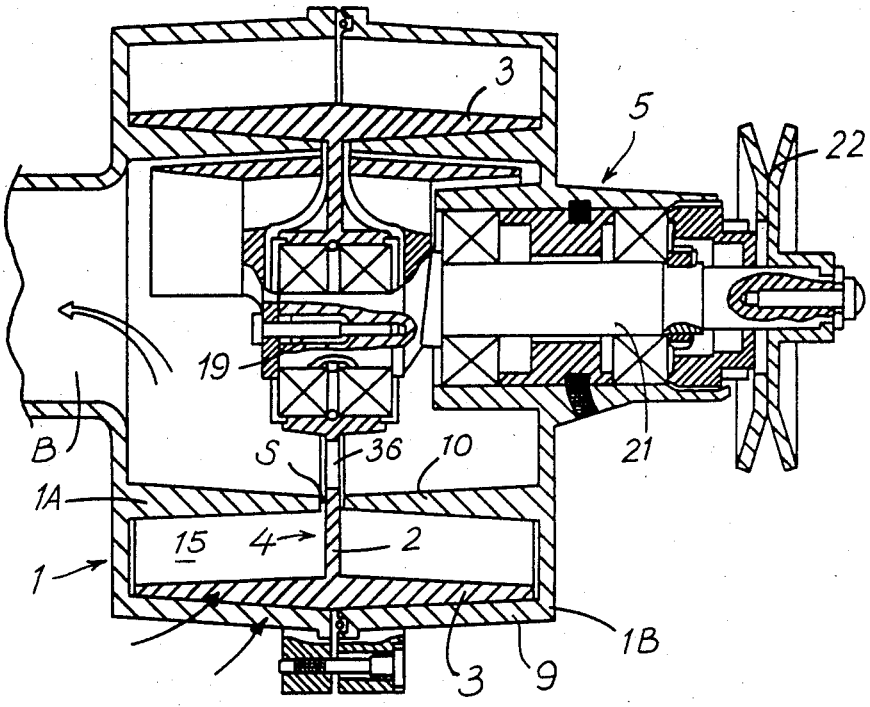
FIG. 3 is a longtudinal sectional view of the machine.

The axial surfaces of the housing wall 9 form the contact surfaces of the housing halves 1A, 1B which can be fastened together as shown in FIG. 3 while the inner wall 10 is formed with a slot S (FIG. 3) in which passes the disc 2 of the piston 4. The slot S has a boundary edge 16 which forms a residual gap 17 with the edge of disc 2. The gap 17 varies in size as a function of the position of the piston 4. Fluid enters the housing at inlet A and the fluid is pressurized in its passage through chambers 13,14,15. The pressurized fluid passes through apertures 36 formed in the disc 2 for discharge from outlet B. The apertures 36 are always disposed within the outline of wall 10 of the housing. The gap 17 provides communication between chambers 14 and 15 and therefore short-circuits these chambers.

Upon conveyance of the fluid from the outside towards the inside, this means that a return flow takes place through the residual gap 17. The construction of the invention seeks to minimize this return flow.

In this regard, the disc 2 of the piston 4 has, between the overlapped spiral wall 3, an approximately S-shaped contour 18 which is determined by the edge 16 relative to the travel of the piston 4 in this region so that the distance between the disc 2 and the housing edge 16 i.e. gap 17 remains constant at least during one-half a revolution of the crank mechanism i.e. whenever the central pivot 19 of the piston 4 moves on the left side of the circular path 6 produced by rotation of eccentric crank shaft 21 under the drive at pulley 22.

Figure 4:
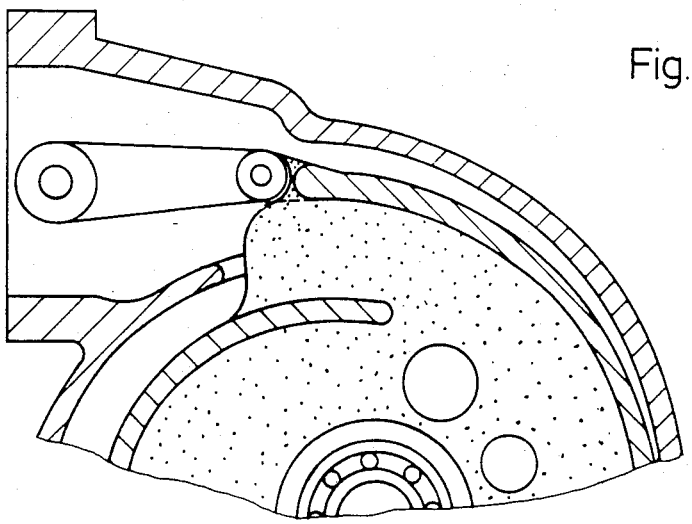
FIG. 4 is a view similar to FIG. 1 with the piston of the machine in a displaced angular position of 90°.

On the other hand, when the crank pivot 19 moves along the right-hand side of the circular path 6 (FIG. 4), an unavoidable residual gap 17 is produced which is dependent on the instantaneous position.

This gap can be reduced by minimizing the wall thickness of disc 2 so that it is desirable to produce the disc of a material of high strength and to integrate the spiral rib 3 with the disc 2 by casting or connection in suitable manner. The disc 2 is made of minimized thickness as exemplified by the illustration in FIG. 3 where the thickness of disc 2 is substantially less than the thickness of the spiral wall of the displacement body.

Figure 5:
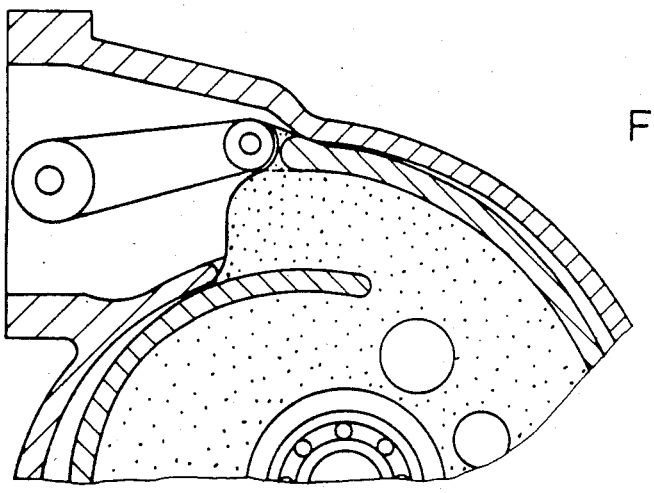
FIG. 5 is a view similar to FIG. 1 with the piston of the machine in a displaced angular position of 180°.
Figure 6:
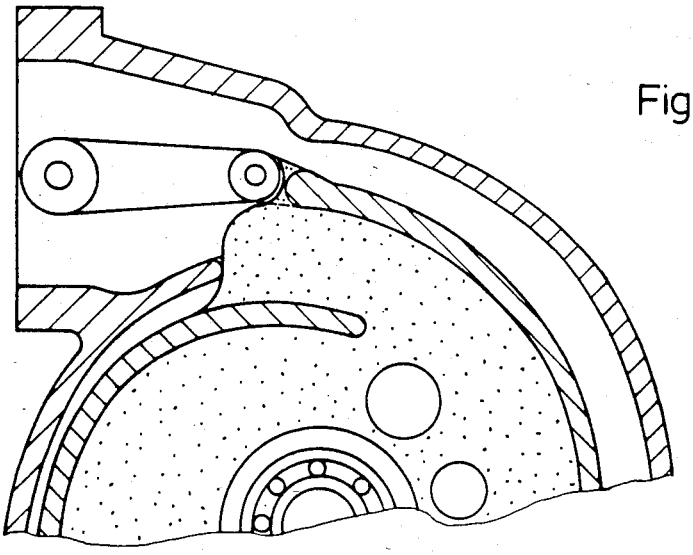
FIG. 6 is a view similar to FIG. 1 with the piston of the machine in a displaced angular position of 270°.

FIG. 2 shows on a larger scale a portion of FIG. 1 with the housing wall 9 and rib 10, the spiral wall 3 of the piston 4 and the crank arm 7. The pivotal connection of the arm 7 to disc 2 is shown by a lug 20, the S-shape of edge 18 of the disc being apparent to indicate the constant magnitude of the residual gap 17. Namely, as shown in FIGS. 5, 6 and 2, when the piston 4 is in the compression stroke (the left side of circular path 6) the gap 17 is minimally constant.

Although the invention has been disclosed in relation to a specific embodiment thereof, it will become apparent to those skilled in the art that numerous modifications and variations can be made within the scope of the invention as defined in the attached claims.

What is claimed is:

1. A displacement machine for a fluid comprising a housing including a spiral wall, a displacement body including a spiral wall engaged with said spiral wall of said housing to form chambers therewith, said spiral wall of said displacement body extending over an angle greater than 360° to provide overlapping first and second ends, said displacement body further including a transverse disc from which said spiral wall extends axially on both sides of said transverse disc, means connected to said displacement body to rotate the same along a closed circular path, and a crank arm pivotably connected to said housing at a first pivot axis and to said displacement body at a second pivot axis in the region of said spiral wall of said displacement body, said second pivot axis being spaced from the center of rotation of said closed circular path to cause said displacement body to undergo reciprocal movement along an open path at said second pivot axis, said transverse disc having a radial terminal edge extending between said overlapping first and second ends of said spiral wall of said displacement body, said spiral wall of said housing having a slot in which said disc is received, said spiral wall of said housing having a bounding edge for said slot facing said terminal edge of said disc in spaced relation therewith, said terminal edge of said disc having a shape corresponding to the path of movement of said terminal edge of said disc relative to said bounding edge upon movement of said displacement body so that the distance between said terminal edge of said disc and said bounding edge remains substantially constant at least during one-half of the travel of said displacement body along said closed circular path.

2. A displacement machine as claimed in claim 1 wherein said terminal edge of said disc is S-shaped.

3. A displacement machine as claimed in claim 1 wherein said disc has a smaller thickness than said spiral wall of said displacement body.

* * * * *